US009272897B2

(12) United States Patent
Daniels et al.

(10) Patent No.: US 9,272,897 B2
(45) Date of Patent: Mar. 1, 2016

(54) PORTABLE TRANSPORTABLE STORAGE UNIT FOR DISPENSING A FUEL ADDITIVE

(71) Applicant: Titan Chemical Transfer Solutions, LLC, Greenville, SC (US)

(72) Inventors: Mark Daniels, Greenville, SC (US); Henrik Rokkjaer, Fernley, NV (US)

(73) Assignee: Titan Chemical Transfer Solutions, LLC, Greenville, SC (US)

( * ) Notice: Subject to any disclaimer, the term of this patent is extended or adjusted under 35 U.S.C. 154(b) by 98 days.

(21) Appl. No.: 14/304,275

(22) Filed: Jun. 13, 2014

(65) Prior Publication Data

US 2015/0360928 A1 Dec. 17, 2015

(51) Int. Cl.

| | |
|---|---|
| ***B67D 7/80*** | (2010.01) |
| ***B67D 7/02*** | (2010.01) |
| ***B67D 7/42*** | (2010.01) |
| ***B67D 7/62*** | (2010.01) |
| ***B67D 7/82*** | (2010.01) |
| ***B67D 7/84*** | (2010.01) |

(52) U.S. Cl.

CPC .. *B67D 7/02* (2013.01); *B67D 7/42* (2013.01); *B67D 7/62* (2013.01); *B67D 7/82* (2013.01); *B67D 7/84* (2013.01)

(58) Field of Classification Search

CPC ..... B67D 7/04; B67D 7/06; B67D 7/02; B67D 7/56; B67D 7/38; B67D 7/58; B67D 7/62; B67D 7/78; B67D 7/82; B67D 7/84; B67D 7/42; B67D 7/0288; B67D 7/0294; B67D 7/36

See application file for complete search history.

(56) References Cited

U.S. PATENT DOCUMENTS

| | | | | |
|---|---|---|---|---|
| 4,719,991 | A * | 1/1988 | Diehn | B67D 7/04 137/355.26 |
| 5,533,648 | A * | 7/1996 | Read | B67D 7/78 119/56.1 |
| 5,881,760 | A * | 3/1999 | Del Zotto | B67D 7/04 137/264 |
| 8,234,854 | B2 * | 8/2012 | Kesse | F01N 3/208 60/286 |
| 2002/0033200 | A1 * | 3/2002 | Alex | B67D 7/007 141/323 |
| 2005/0242109 | A1 * | 11/2005 | Reed | B67D 7/0205 222/1 |
| 2006/0016832 | A1 * | 1/2006 | Koch | B67D 7/0277 222/383.1 |
| 2010/0200107 | A1 * | 8/2010 | Weathers | B67D 7/02 141/4 |
| 2011/0006080 | A1 * | 1/2011 | Naylor | B67D 7/82 222/146.2 |
| 2012/0024892 | A1 * | 2/2012 | Bartlett | B67D 7/04 222/54 |
| 2012/0103433 | A1 * | 5/2012 | Koonce | F02M 31/125 137/341 |
| 2015/0252712 | A1 * | 9/2015 | Foster | B67D 7/78 60/295 |

* cited by examiner

*Primary Examiner* — Patrick M Buechner

(74) *Attorney, Agent, or Firm* — McNair Law Firm, P.A.; Douglas W. Kim

(57) ABSTRACT

A portable storage unit for a fuel additive such as DEF comprising: a housing including a tray support and a cover; a container disposed in the lower area for containing a fluid; a first heating element disposed between an inner wall of the housing and the outer wall of the container; a fluid pump removable attached to the tray for pumping fluid from the container to a nozzle and for being removed from the tray to pump fluid from an external fluid source into the container; an intake hose connected to a coupler providing fluid communications between the container and the fluid pump.

18 Claims, 2 Drawing Sheets

PORTABLE TRANSPORTABLE STORAGE UNIT FOR DISPENSING A FUEL ADDITIVE

FIELD OF THE INVENTION

This invention is directed to a portable fluid dispenser and more specifically to a portable DEF storage system and dispenser.

BACKGROUND OF THE INVENTION

In the United States, the Clean Air Act established emission standards to regulate several pollutants that include nitrogen oxide (NOx), particulate matter (PM), carbon monoxide (CO), and hydrocarbons. One challenge for engine operators, under the Clean Air Act, is to limit the NOx emissions to comply with the ammonium g/bhp-hr standards. For operators of diesel engines, this standard proved to be problematic. One solution is known as the Selective Catalytic Reaction (SCE) technology.

SCR is an "after treatment" technology to reduce the NOx in the exhaust emissions of a diesel engine. The SCR relies upon an operating fluid called Diesel Exhaust Fluid or DEF. DEF is injected into the exhaust pipe in front of a SCR catalyst and downstream of the engine. The heat of the engine exhaust causes the DEF to decompose into ammonia. The NOx reacts with the ammonia in the catalyst and the Nox molecules are converted into $N_2$ and $H_2O$.

DEF is a solution that is about 32% of a high-priority area in deionized water THE DEF is stored as a separate DEF tank, which is connected to the DEF injector. The average consumption of DEF is about 3% per gallon of diesel fuel so that the DEF tank is significantly smaller than the fuel tank.

Historically, operators would purchase DEF in small portable containers that would only hold a few gallons and use these portable containers to fill the DEF tanks associated with the diesel engine. Since about 3 gallons of DEF would be needed for about 100 gallons of fuel plastic containers from 35 to 15,000 gallons, over time, bulk containers began to appear and were located on-site of the operator so that the DEF tank was filled from a bulk dispenser.

However, storage of DEF began to exhibit problems due to the nature of DEF. For example, DEF freezes around 12° F. and will expand about 7%. As a result, the container expands and there is damage to the hose and pump. Additives should not be added to DEF to reduce the freezing point, as such additives can harm the SRC catalyst.

Another difficulty created by the Clean Air Act is to have diesel engines that are used in remote areas to have DEF sources that are portable. For example, farm equipment, construction equipment, diesel engines, and the like. Many of these diesel engines operate in location that are remote from fuel sources and therefore have high capacity fuel tanks. It would be advantageous to have a portable DEF source so that the diesel equipment would not have to leave it operational area to refill on DEF.

Another hurdle to portable DEF supplies is DEF's freezing point. Since DEF in a container above is not useful, a pump, power source for the pump, hose, and nozzle are also a consideration. If DEF fluid is "trapped" in the hose, pump, or nozzle and then freezes and expands, the hose, pump, and nozzle can be cracked or otherwise damaged.

Additionally, portable DEF supplies also need to be refilled and it would be advantageous to be able to use the same hose, pump, and nozzle to fill the portable DEF source from a bulk container that is used to fill the DEF tank of a diesel engine from the DEF portable supply.

Another challenge that exists for portable DEF source is the dust, dirt, and water (rain, snow, ice) that the portable DEF can damage the pump. Furthermore, water can enter the nozzle, freeze, and damage the nozzle. It would be advantageous to have a portable DEF source that is protected from the environment.

Therefore, it is also an object of this invention to provide a portable DEF source that is shielded from environmental hazards.

It is also an object of the present invention to provide for a dispensing assembly that can be used to fill the portable DEF source from a bulk storage container and to fill a DEF tank on a diesel engine from the portable DEF source.

SUMMARY OF THE INVENTION

The objective of the present invention are accomplished by providing a portable storage unit for a fuel additive comprising: a housing having a lower area, an upper area divided by a tray support and a cover; a container disposed in the lower area for containing a fluid having between 25 and 45% urea; a first heating element disposed between an inner wall of the housing and the outer wall of the container; a tray carried by the tray support disposed in the upper area; a fluid pump removable attached to the tray for pumping fluid from the container to a nozzle and for being removed from the tray to pump fluid from an external fluid source into the container; an intake hose connected to a coupler providing fluid communications between the container and the fluid pump; an output hose connected between the pump and a nozzle for delivering fluid from the container; a power connection for connecting power to the pump and the first heating element; a thermostat connected to the power connection and the first heating element for switching on and off the power to the heating element to maintain the temperature within the container above 12° F. when the cover is closed; a viewing strip defined in the housing for viewing a level indicator representing the volume of fluid in the container; and, a fill opening defined in the tray and in fluid communication with the interior of the container.

The unit can including removable pump plate removably connected to the tray and connected to the pump for attaching the pump to an external fluid source wherein the pump plate includes a bracket for hanging the plate and pump on the external fluid source. The tray can include a bracket opening defined in the tray for receiving the bracket when the plate is attached to the tray. The nozzle can be a DEF nozzle.

The unit can include a nozzle opening defined in the tray for receiving the nozzle when the nozzle is not in use. The fill opening can be arranged only to accept DEF nozzles. A gap between the housing and the tray can be present so that air can flow between the lower area and the upper area.

A lock recess can be defined in the housing for receiving a lock for securing the cover in a closed position. A stand can be included attached to the container and have opening define din the stand for receiving a forklift.

A second heating element can be disposed between the top of the container and the bottom of the tray. The fuel additive stored in the container can include a water resistant carbon steel housing for containing a fluid having between 25% and 45% urea and 55% and 75% de-ionized water;

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DETAILED DESCRIPTION OF THE INVENTION

Figure 1:
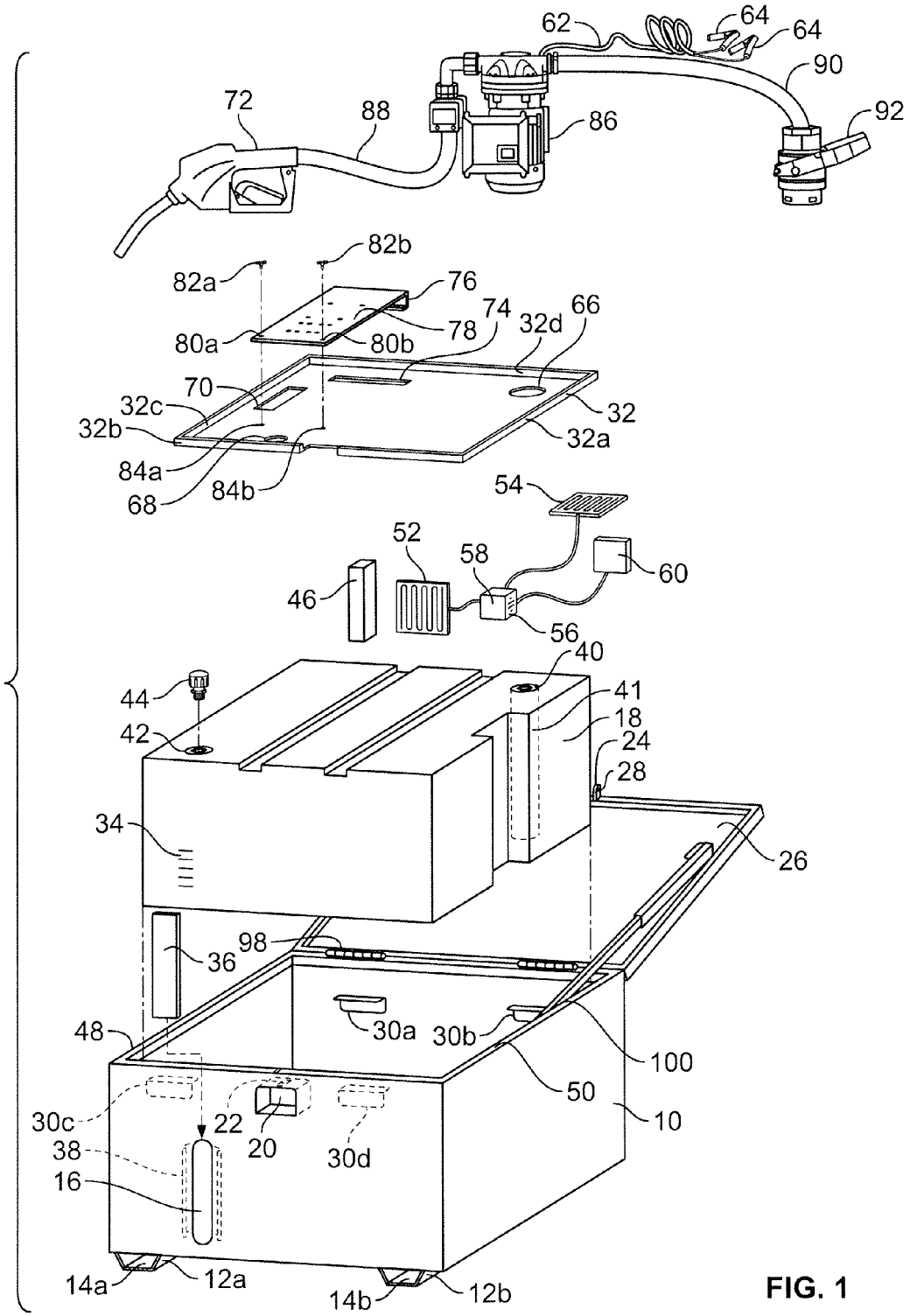
FIG. 1 is a perspective of various components of the invention.

Referring to FIG. 1, a housing 10 is shown having stands 12*a* and 12*b*. The stands can define opening 14*a* and 14*b* that are arranged to receive the forks of a fork lift to allow for transportation and maneuvering of the housing. The housing can include fluid level indicator 16 that is defined in the housing in one embodiment. The fluid level indicator can be an opening in the housing that allows the fluid level container 18 to be seen external of the housing.

A lock recess 20 can be included in the housing to receive a lock. The lock recess can include a lock recess opening 22 for receiving a lock tab 24 included with cover 26. The lock tab can include a lock tab opening 22 for receiving a lock tab 24 that is attached to cover 26. The lock tab can include a lock opening 28 so that when the lock tab is received in the lock recess, a lock can be inserted in the lock tabs opening to secure the cover closed.

The cover can be hingably attached to the housing by hinge 98. The cover can be supported by a cover support arm 100. The cover support arm can have a locked position to support the cover in an open position and an unlocked position to allow the cover to close. The cover support arm can be telescoping or pneumatic.

The housing can include tray supports 30*a* through 30*d*. In one embodiment, the tray that supports 30*c* and 30*d* can extend into the interior of the housing so that tray a 32 is supported in the housing. The tray can be disposed in the housing so that a gap exists between the side wall of the tray and the interior wall of the housing. Therefore, air can flow from the space below the tray to the space above the tray.

A container 18 is disposed in the housing and can include indicator markings 34 on the container. The container can be placed in the housing so that the indicator lines are visible through the fluid level indicator. In one embodiment, the indicator markings are on a indicator plate 36 that can be attached to indicator plate clips 38 so that the indicator markings are visible to the operator.

The container can include a dispensing port 40, attached to a snorkel 41, and fill port 42. The fill port can include a fill port cap 44 to seal the fill port when it is not in use. When placed in the housing, the container can be biased forward by a spanner 46 that is disposed between the interior back wall of the container and the container so that the fluid level indicator and so the container does not travel within the housing. The housing can include a lip 48 that is operatively associated with the cover to provide a barrier to reduce the amount of dust and debris that can enter the housing when the cover is closed. A seal 50 can be attached to the lip to further seal the housing. In one embodiment, the seal is weather stripping.

In one embodiment, a first leading element 52 is disposed in the housing vertically between the container and the housing inner wall. A second heating element 54 can be disposed between the top of the container and the bottom of the tray or on the opposite side of the container or on another side of the container. The heating elements can be corrected to internal power source 56 and controller 58. A thermocouple 60 can be connected to the controller so that when the controller determines that the ambient temperature in the housing drops to a predetermined temperature, the heating elements are powered to raise the temperature. In one embodiment, the predetermined temperature is greater than 12° F. The heat generated under the tray from the heating elements causes warmer air to rise through the gap between the tray and inner wall of the housing. Therefore, the space above the tray can be kept above 12° F.

In one embodiment, the controller and heating element are connected to an external power source, such as unit power cables 62 and power cable clamps 64. Therefore, an external power source, such as a batter, can be used to power the heating elements.

The tray can include side walls 32*a* through 32*d*. In the event that fluid is spilled, the tray can prevent some or all of the fluid from reaching the area of the housing below the tray. This is especially advantageous since DEF is slightly corrosive.

The tray can include a dispensing opening 66 so that the dispensing port can be accessed with the tray in place. The tray can include a fill opening 68 so that the fill port can be accessed when the tray is in place. The tray can include a nozzle opening 70 for receiving nozzle 72 providing for the storage of the nozzle when the nozzle is not in place. The tray can include a pump bracket opening 74 for receiving a pump bracket 76 that is attached to a pump plate 78. The pump plate includes fastener openings 80*c* and 80*b* that receive fasteners 82*a* and 82*b* that can extend through the pump plate into tray fastener openings 84*a* and 84*b*. In one embodiment, washers can be disposed between the pump plate and tray and receive the fasteners. In one embodiment, the washers are flexible.

A pump 86 can be attached to the pump plate so that the pump and pump plate are removably attached to the tray. Nozzle 72 is connected to the pump to dispense fluid from the container. Fill hose 88 connects the nozzle to the pump. In one embodiment, the nozzle is a DEF nozzle. A dispensing hose 90 is connected between the pump and a dispensing coupling 92. The pump can be powered by an external power source connected to the pump by the power cables and power cable clamps.

Figure 2:
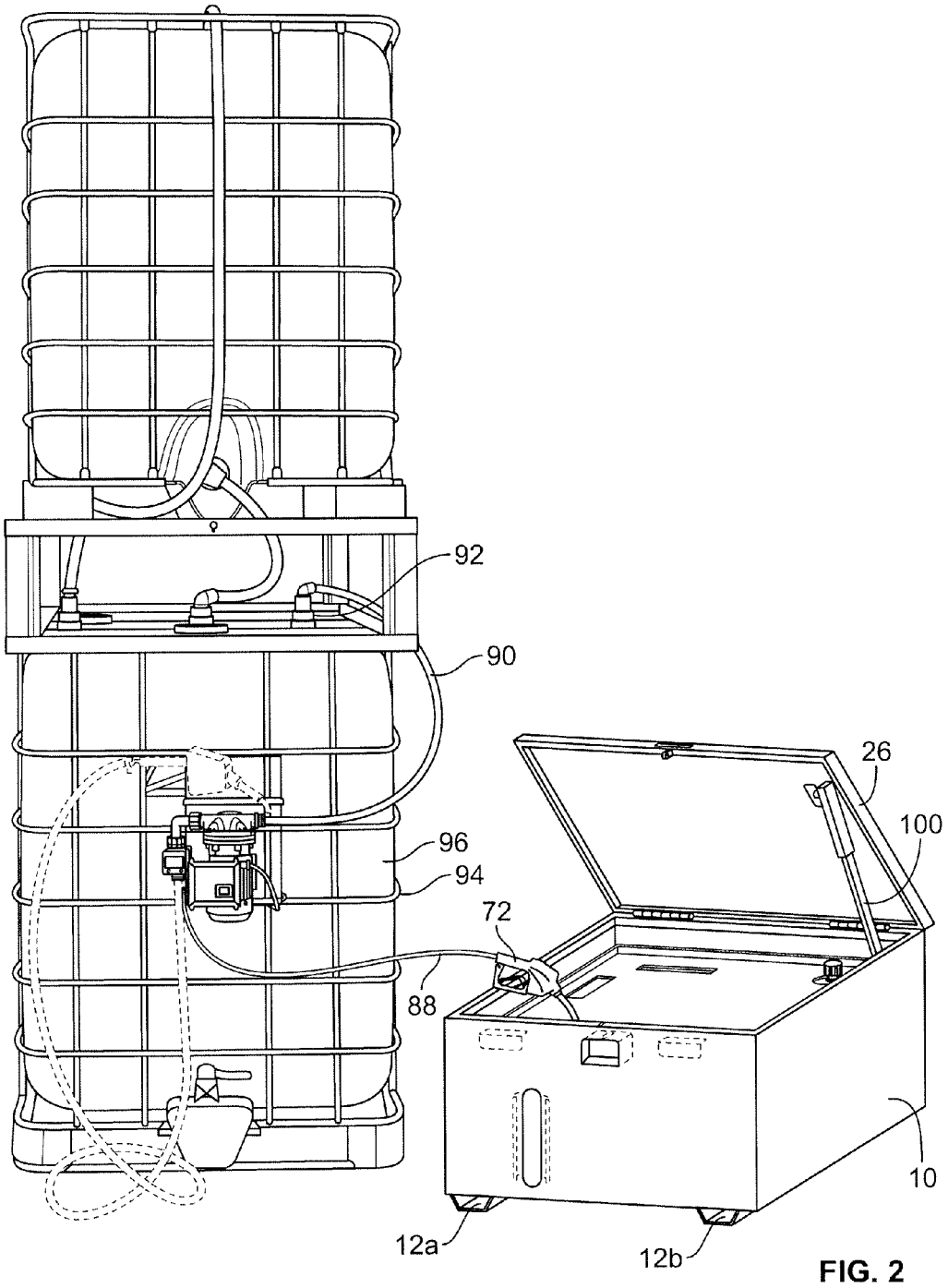
FIG. 2 is a perspective view of the invention in operation.

When in operation, the nozzle is removed from the tray and placed into a diesel engine DEF reservoir. The pump is switched on and the fluid is pumped from the container to the diesel reservoir. When the container needs to be refilled, the pump plate can be removed from the tray and can be removably attached to a bulk storage container shown in FIG. 2. The pump plate can be removably attached to the lower cage 94 to support the pump. The dispensing coupling is connected to the lower tote 96 so that fluid can be pumped from the lower tote into the fill port of the container. The pump can be powered from an external power source, such as the battery from the diesel engine.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to," or other like phrases in some instances shall not be read to mean that the narrower case is intended or required in instances where such broadening phrases may be absent.

What is claimed is:

1. A portable storage unit for a fuel additive comprising:

a housing having a lower area, an upper area divided by a tray support and a cover;

a container disposed in the lower area for containing a fluid having between 25% and 45% urea;

a first heating element disposed between an inner wall of the housing and the outer wall of the container;

a tray carried by the tray support disposed in the upper area;

a fluid pump removably attached to the tray for pumping fluid from the container to a nozzle and for being removed from the tray to pump fluid from an external fluid source into the container;

an intake hose connected to a coupler providing fluid communications between the container and the fluid pump;

an output hose connected between the pump and a nozzle for delivering fluid from the container;

a power connection for connecting power to the pump and the first heating element;

a thermostat connected to the power connection and the first heating element for switching on and off the power to the heating element to maintain the temperature within the container above 12° F. when the cover is closed;

a viewing strip defined in the housing for viewing a level indicator representing the volume of fluid in the container; and, a fill opening defined in the tray and in fluid communication with the interior of the container.

2. The unit of claim 1 including a nozzle opening defined in the tray for receiving the nozzle when the nozzle is not in use.

3. The unit of claim 1 including a gap between the housing and the tray so that air can flow between the lower area and the upper area.

4. The unit of claim 1 including a lock recess defined in the housing for receiving a lock for securing the cover in a closed position.

5. The unit of claim 1 including stands having an opening for receiving a forklift.

6. The unit of claim 1 including a second heating element disposed between the top of the container and the bottom of the tray.

7. The unit of claim 1 including removable pump plate removably connected to the tray and connected to the pump for attaching the pump to an external fluid source.

8. The unit of claim 7 wherein the pump plate includes a bracket for hanging the plate and pump on the external fluid source.

9. The unit of claim 8 wherein the tray includes a bracket opening defined in the tray for receiving the bracket when the plate is attached to the tray.

10. A portable storage unit for a fuel additive comprising:

a container carried in a water resistant carbon steel housing for containing a fluid having between 25% and 45% urea and 55% and 75% de-ionized water;

a tray disposed above the container and contained within the water resistant housing;

a fluid pump removably attached to the tray for pumping fluid from the container and for being removed from the tray to pump fluid from an external fluid source into the container;

a heating element disposed between the container and the housing;

a power connection for connecting power to the pump and the heating element; and, a thermostat connected to the power connection and heating elements for switching on and off the power to the heating element to maintain the temperature above 12° F. in the container.

11. The unit of claim 10 wherein the heating element is disposed vertically in the housing alongside the container and horizontally between the container and the tray.

12. The unit of claim 10 including a cover hingeably attached to the container.

13. The unit of claim 12 including a seal carried between the container and the cover.

14. The unit of claim 10 including a removable pump plate removably connected to the tray and connected to the pump for attaching the pump to an external fluid source.

15. The unit of claim 14 wherein the pump plate includes a bracket for hanging the plate and pump on the external fluid source when removed from the tray.

16. A portable storage unit for a fuel additive comprising:

a reservoir of fluid having between 25% and 45% urea;

a reservoir spring biased high flow valve included in the reservoir;

a portable housing having a container for receiving the fluid from the reservoir and dispensing the fluid into a vehicle;

a coupling removably connected to the container providing fluid communication between the interior of the container and the coupling;

a pump attached to a pump plate removably connected to the portable housing and in fluid communications with the interior of the container when attached to the coupling;

a nozzle attached to the pump;

a fill opening defined in the container; and, whereas the pump and coupling can be removed from the portable housing and attached to the reservoir for transferring fluid from the reservoir to the container by inserting the nozzle into the fill opening.

17. The unit of claim 16 including a heating element disposed in the portable housing to 12° F. in the container and around the pump.

18. The unit of claim 16 wherein the pump plate includes a bracket for hanging the plate and pump on the reservoir.

* * * * *